US006331751B1

(12) United States Patent
Kwak et al.

(10) Patent No.: US 6,331,751 B1
(45) Date of Patent: Dec. 18, 2001

(54) INNER SHIELD COUPLING STRUCTURE FOR CRT

(75) Inventors: Jong-Seop Kwak, Pusan; Kyeung-Yae Kang, Kyongsangbuk-do, both of (KR)

(73) Assignee: SamSung SDI Co., Ltd., Suwong (KR)

( * ) Notice: Subject to any disclaimer, the term of this patent is extended or adjusted under 35 U.S.C. 154(b) by 0 days.

(21) Appl. No.: 09/397,912

(22) Filed: Sep. 17, 1999

(30) Foreign Application Priority Data

Mar. 29, 1999 (KR) ..... 99-5009

(51) Int. Cl.[7] ..... H01J 29/80

(52) U.S. Cl. ..... 313/402

(58) Field of Search ..... 313/402, 479

*Primary Examiner*—Vip Patel
(74) *Attorney, Agent, or Firm*—Robert E. Bushnell, Esq.

(57) ABSTRACT

An inner shield for CRT includes a first protrusion having an upper indented portion and a lower indented portion, and a second protrusion having an upper band and a lower band, wherein the bands are asymmetrical.

3 Claims, 3 Drawing Sheets

Fig. 5 *(Prior Art)*

INNER SHIELD COUPLING STRUCTURE FOR CRT

BACKGROUND OF THE INVENTION

1. Field of the Invention

The present invention relates to an inner shield for cathode ray tube, and more particularly, to an improved inner shield capable of maintaining its tubular shape without distortion.

2. Description of the Related Art

A cathode ray tube (CRT) is generally used as an image displaying unit for television, computer monitors, etc. The CRT displays images by emitting visual rays when electron beams emitted from an electron gun hit a screen panel coated with red, green, and blue phosphors.

A CRT includes a screen panel for showing an image, an electron gun for emitting electron beams, a deflection yoke for deflecting a travel direction of electron beams, a shadow mask for transmitting electron beams, and a funnel holding the above elements.

The screen panel and funnel are sealed together for maintaining a vacuum inside the funnel such that electrons progress in a suitable manner therein.

The electron gun is installed inside the funnel, and the deflection yoke is circumferentially mounted around the funnel. The shadow mask is attached by welding to a mask frame, which is mounted inside the screen panel by means of springs and stud pins. The screen panel is patterned by red, green, and blue phosphors on an inner surface of the screen panel.

The elements such as the shadow mask, mask frame, and plate springs installed inside the CRT are made of ferromagnetic materials, i.e. Fe, such that the elements are magnetized to like poles according to variation of earth magnetic field, resulting in distorting the reflection of the electron beams. Accordingly, the electron beams may not hit correct phosphors.

In the conventional CRT, to solve the above described problems, an inner shield is mounted by using a clip on a rear part of the mask frame.

The inner shield is made out of a steel sheet having low permeability and in a similar shape with the funnel for preventing the reflection of the beam from being obstructed. The inner shield is either an integral type or a separable type of which two parts are assembled.

FIG. 5 is a drawing overlapping a development view with a top plane view of a prior art inner shield.

In FIG. 5, reference numeral 2 denotes workpieces cut and bent according to a predetermined design. In one workpiece 2*a*, a first protrusion part 4 is formed with indented portions 4*a* and 4*b*, and in the other workpiece 2*b*, a second protrusion part 6 is formed with a plurality of bands 6*a* and 6*b*.

The inner shield is integrated by binding the bands 6*a* and 6*b* of the second protrusion part 6 around the first protrusion part 4.

The inner shield includes opposite side walls 10 having windows 8 and flanges 12 continuously formed in a lower part of the side walls 10. A central opening 14 is formed in a longitudinal direction of an axis of the CRT such that the electron beams pass through the central opening 14. The flanges 12 are welded to the mask frame (not shown).

To assemble the inner shield precisely, widths of the indented portions 4*a* and 4*b* may be formed 2 mm wider than the width of the bands 6*a* and 6*b* such that a gap of approximately 1 mm is formed between side walls of the indented portion 4*a* and 4*b* and side edges of the bands 6*a* and 6*b* when the indented portions 4*a* and 4*b* are bound by the bands 6*a* and 6*b*. The inner shields assembled in this manner are typically stacked for subsequent process.

However, if a plurality of inner shields are stacked, the inner shields, except for the one on top of the stack, receive a load equal to the number of inner shields stacked thereon, such that gaps between the indented portions 4*a* and 4*b* and the bands 6*a* and 6*b* are distorted.

That is, a left side wall of the upper indented portion 4*a* and a left side edge of the upper band 6*a* contact each other, and a right side wall of the lower indented portion 4*b* and a right side edge of the lower band 6*b* contacted each other by concentration of the load.

Accordingly, the coupling portion of the first and second protrusions 4 and 6 droops so as to distort the contour of the inner shield. Particularly, the distortion of the central opening and the window deteriorates the ability of the inner shield to block the earth magnetic field so as to cause deterioration in purity of the CRT.

In more serious cases, the distorted inner shield obstructs the progress of the electron beams such that the electron beams do not reach the screen panel of the CRT.

SUMMARY OF THE INVENTION

The present invention has been made in an effort to solve the problems of the prior art.

It is an object of the present invention to provide an improved inner shield which prevents a central opening and window from being permanently distorted.

To achieve the above object, the inner shield of the present invention comprises a first protrusion having upper and lower indented portions, and a second protrusion having upper and lower bands, wherein the bands are formed asymmetrically.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 5 is a drawing overlapping a development view with a top plane view of a prior art inner shield.

DETAILED DESCRIPTION OF THE PREFERRED EMBODIMENTS

A preferred embodiment of the present invention will be described hereinafter with reference to the accompanying drawings.

Figure 1:
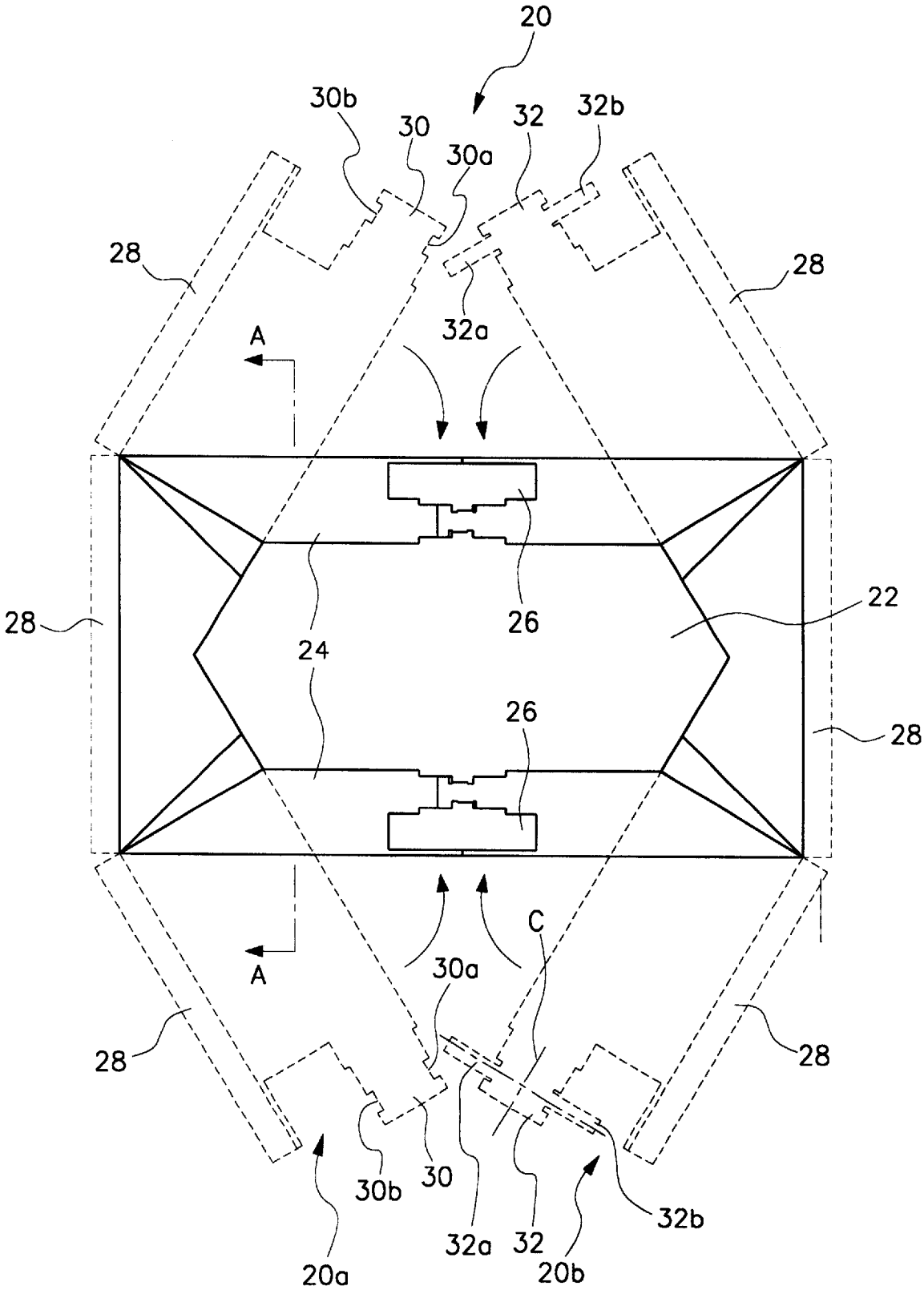
FIG. 1 is a plane view of an inner shield according to a preferred embodiment of the present invention.
Figure 2:
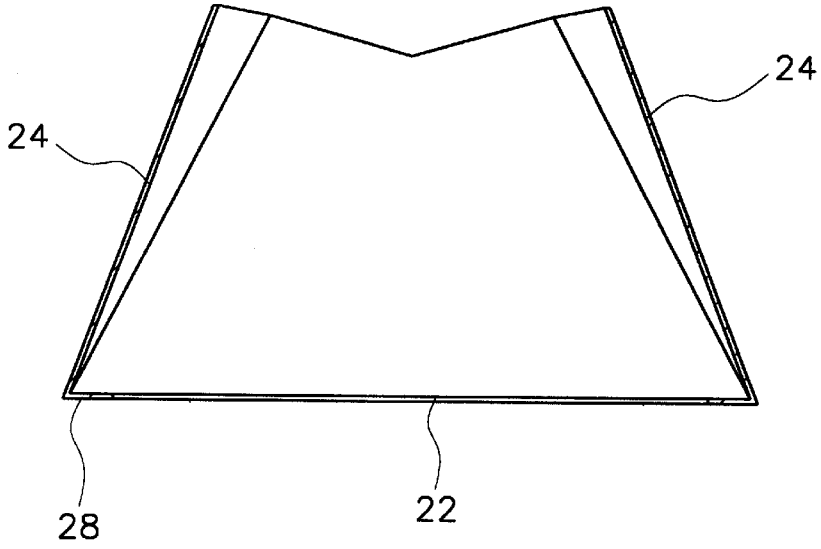
FIG. 2 is a cross-sectional view cut along line A—A of FIG. 1.
Figure 3:
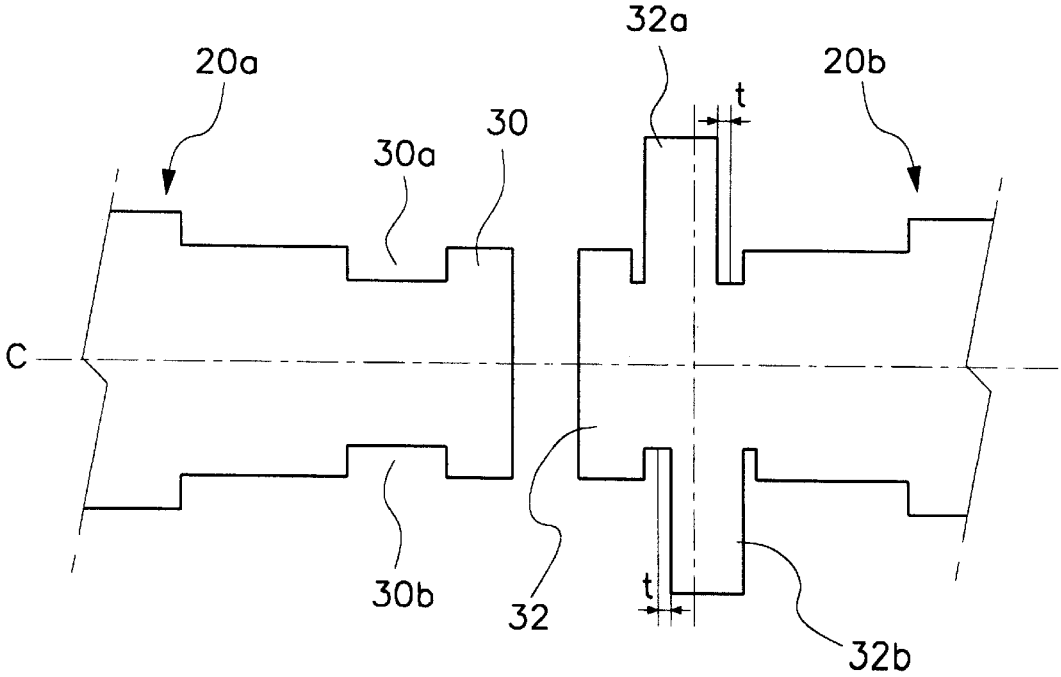
FIG. 3 is a partial view showing coupling portions of inner shield of FIG. 1 before being coupled.
Figure 4:
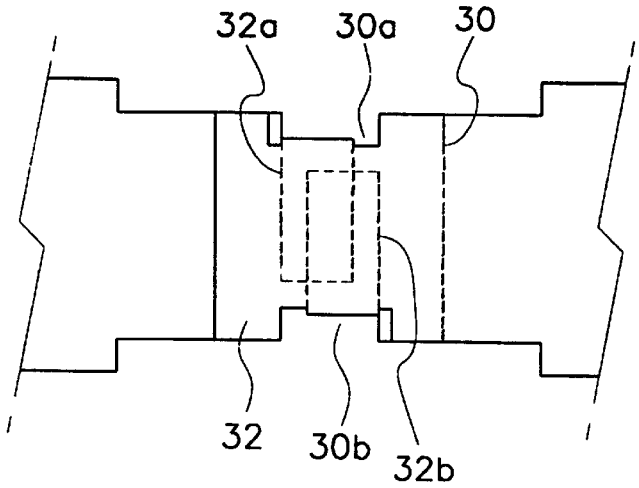
FIG. 4 is a partial view showing coupling portions of FIG. 3 after being coupled.
Figure 4:
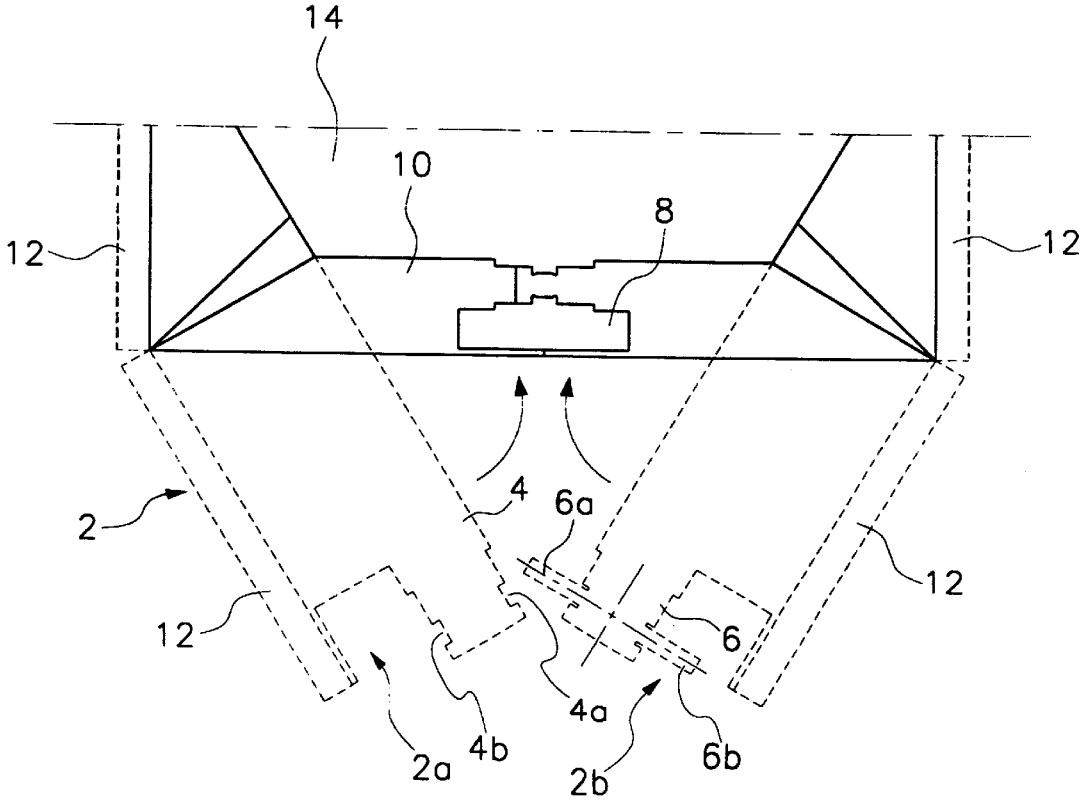

FIG. 1 is a plane view of an inner shield according to a preferred embodiment of the present invention, FIG. 2 is a cross-sectional view cut along line A—A of FIG. 1, and FIG. 3 is a partial view showing coupling portions of inner shield of FIG. 1.

In FIG. 1, reference numeral 20 denotes workpieces cut and bent according to a predetermined design. The two workpieces 20 are coupled to each other so as to form an inner shield having a square shape plane view. By coupling the two workpieces, a central opening 22 is formed such that electron beams pass therethrough, and windows 26 for reducing a travel amount of the electron beams are formed in a pair of opposite walls 24. Also, flanges 28 are expanded downward and bent inward so as to be welded to a mask frame (not shown).

The one workpiece is formed having first protrusions 30 at its longitudinal opposite ends with indented portions 30*a* and 30*b*, and the other workpiece is formed having second protrusions 32 at its longitudinal opposite ends with coupling bands 32*a* and 32*b*.

As shown in FIG. 3, the coupling bands 32*a* and 32*b* are formed asymmetrically. That is, when folding the second protrusion 32 along a line "C", the outlines of the upper band 32*a* and the lower band 32*b* do not correspond to each other. The difference between the upper and lower coupling bands 32*a* and 32*b* is "t" in their position.

That is, the upper band 32*a* is formed nearer than the lower band 32*b* to the end of the second protrusion 32 such that when the bands 32*a* and 32*b* are bound around the first protrusion 30, a left side edge of the upper band 32*a* is contacted to a left side wall of the upper indented portion 30*a*, and a right edge of the lower band 32*b* is connected to a right side wall of the lower indented portion 30*b*.

Accordingly, even if a plurality of assembled inner shield is stacked such that the weight of the inner shields are concentrated on the coupling portions, the inner shields are not distorted.

That is, the upper band 32*a* of the second protrusion 32 is bound around the upper indented portion 30*a* without a gap at their left contact portion, and the lower band 32*b* of the second protrusion 32 is bound around the lower indented portion 30*b* without a gap at their right contact portion, such that it is possible to prevent the inner shield from being distorted.

As described above, since the inner shield of the present invention is formed by winding the bands of the second protrusion around the indented portions of the first protrusion without a gap between the side edges of the bands and the side walls of the indented portion, the inner shield can withstand a substantial load without distorting, including a load given by stacking.

Thus, the inner shield made of according to the present invention prevents the inner shield itself from obstructing the progress of the electron beams by distortion of the inner shield, resulting in enhancing the reliability of the CRT equipped with the inner shield.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An inner shield for CRT comprises a first protrusion having an upper indented portion and a lower indented portion, and a second protrusion having an upper band and a lower band, wherein the bands are asymmetrical.

2. An inner shield of claim 1 wherein the upper band is formed nearer to a longitudinal end of the second protrusion than the lower band.

3. An inner shield assembly for CRT comprises a first wing portion and a second wing portion joined at the ends of the wings such that the inner shield takes on a substantially bowl-like shape with the bottom open as well as the top, wherein one of the wings has extensions in both directions at its end perpendicular to the longitudinal axis of the wing, wherein the extension in one of the direction is off-axis with the extension in the other direction such that the two extensions do not completely overlap with each other when they are wrapped around the end of the second wing.

* * * * *